US007128544B1

(12) United States Patent
Del Rio

(10) Patent No.: US 7,128,544 B1
(45) Date of Patent: Oct. 31, 2006

(54) CRESCENT SEAL FOR THE CYLINDER OF A VANE MOTOR

(75) Inventor: Eddy H. Del Rio, Royal Palm Beach, FL (US)

(73) Assignee: The Anspach Effort, Inc., Palm Beach Gardens, FL (US)

( * ) Notice: Subject to any disclaimer, the term of this patent is extended or adjusted under 35 U.S.C. 154(b) by 0 days.

(21) Appl. No.: 11/101,695

(22) Filed: Apr. 8, 2005

Related U.S. Application Data

(60) Provisional application No. 60/567,188, filed on Apr. 30, 2004, provisional application No. 60/567,189, filed on Apr. 30, 2004.

(51) Int. Cl.
*F01C 21/00* (2006.01)
*F03C 2/00* (2006.01)
*F04C 15/00* (2006.01)

(52) U.S. Cl. ..... 418/270; 418/82; 418/107; 418/140; 418/159; 418/259; 418/268; 418/269

(58) Field of Classification Search ..... 418/82, 418/107, 159, 178, 259, 266–270, 140, 144
See application file for complete search history.

(56) References Cited

U.S. PATENT DOCUMENTS

| | | | | |
|---|---|---|---|---|
| 2,733,663 | A * | 2/1956 | Marshall | 418/269 |
| 3,809,020 | A * | 5/1974 | Takitani | 418/178 |
| 3,865,520 | A * | 2/1975 | Kramer et al. | 418/82 |
| 3,994,641 | A * | 11/1976 | Southard | 418/269 |
| 4,799,867 | A * | 1/1989 | Sakamaki et al. | 418/178 |
| 5,501,586 | A * | 3/1996 | Edwards | 418/159 |
| 5,571,244 | A * | 11/1996 | Andres | 418/92 |

FOREIGN PATENT DOCUMENTS

| | | | | |
|---|---|---|---|---|
| JP | 57016202 | A * | 1/1982 | 418/129 |

* cited by examiner

*Primary Examiner*—Theresa Trieu
(74) *Attorney, Agent, or Firm*—Norman Friedland

(57) ABSTRACT

A vane motor is modified to increase the sealing effectiveness of the gap made at the interface of the spindle and cylinder by undercutting the cylinder a predetermined amount and distance so as to increase the effectiveness of the spindle to cylinder gap and to decrease the requirements for lubrication of the vane motor.

5 Claims, 1 Drawing Sheet

CRESCENT SEAL FOR THE CYLINDER OF A VANE MOTOR

This application claims the benefits under 35 U.S.C. § 119(*e*) of the U.S. provisional patent application 60/567,188 and 60/567,189 filed on Apr. 30, 2004

RELATED APPLICATIONS

This invention relates to the pneumatic motor entitled SURGICAL PNEUMATIC MOTOR and was invented by myself and co-inventor Douglas Perry and identified as Ser. No. 11/082,124 and SURGICAL PNEUMATIC MOTOR FOR USE WITH MRI invented by myself and identified as Ser. No. 11/074,821 both of which were recently filed as non-provisional applications and are incorporated herein by reference and are commonly assigned with this application to The Anspach Effort, Inc.

FEDERALLY SPONSORED RESEARCH OR DEVELOPMENT

Not applicable

TECHNICAL FIELD

This invention relates to pneumatic vane motors of the type that is utilized in surgical drills and more particularly to the interface between the bore surface of the cylinder and the outer surface of the spindle and its sealing characteristics.

BACKGROUND OF THE INVENTION

Rotary machines typically utilize vane motors that are pneumatically powered to cause rotation of the output shaft. As is well known these machines comprise a cylinder, sometimes referred to as a casing and an eccentrically mounted spindle in the cylinder, sometimes referred to as a rotor. The cylinder is stationary and through apertures in the cylinder lead pressurized air to impinge on the working face of the reciprocating vanes mounted in slots formed in the spindle to cause the spindle to rotate and then exhaust the spent air through additional holes formed in the cylinder. The outer edge of the vanes is in contact with the inner surface of the cylinder and the vanes extend in their respective slots during the power stroke of the vane motor and during the exhaust portion of the stroke the vanes retract back into their respective slots. Heretofore, the cylinder had apertures formed therein that were configured in the shape of slots. The pressurized air that is admitted to the spindle and impinges on the working face of the vanes to cause them to rotate the spindle.

This invention is directed toward the interface between the spindle and cylinder so as to enhance the sealing of the gap between the two components resulting in an improvement in the requirements to lubricate the vane motor and rotating machine. The terms "seal" and "sealing" in the context of this application does not refer to independent hardware that typically is inserted at strategic areas in the rotating machine to prevent or reduce leakage, but rather to the configuration of the complementary components that are contoured to reduce the gap between the interfacing parts and therefore eliminate or reduce leakage of fluid from upstream of the configuration to downstream thereof. When this inventive feature is employed in a cylinder at the interface of the cylinder and spindle of a vane motor so as to configure the surface of the inner diameter of the cylinder shape of this surface this change contours this surface from a circular shape to a crescent shape. Accordingly, for use in this description this portion of the interface os referenced as a crescent seal.

SUMMARY OF THE INVENTION

An object of this invention is to provide for a vane motor an improved cylinder/vane of a vane motor.

A feature of this invention is to provide for a rotary machine that includes a pneumatic vane motor an undercut of the cylinder so that the surface of the bore of the cylinder defines an elongated seal at the interface of the spindle surface.

Another feature of this invention is to provide a crescent seal at the interface of the cylinder and vane of a vane motor of a rotary machine that is characterized as enhancing the cylinder to spindle gap to decrease the lubrication requirements of the rotary machine.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While this invention is being described in its preferred embodiment as a vane motor that is utilized in a surgical pneumatic drill, as will be understood by those skilled in this art, this invention can by utilized with any type of pneumatic vane motor which can be modified in accordance with this invention and while the dimensions may change such modification is within the scope of this invention.

Figure 1:
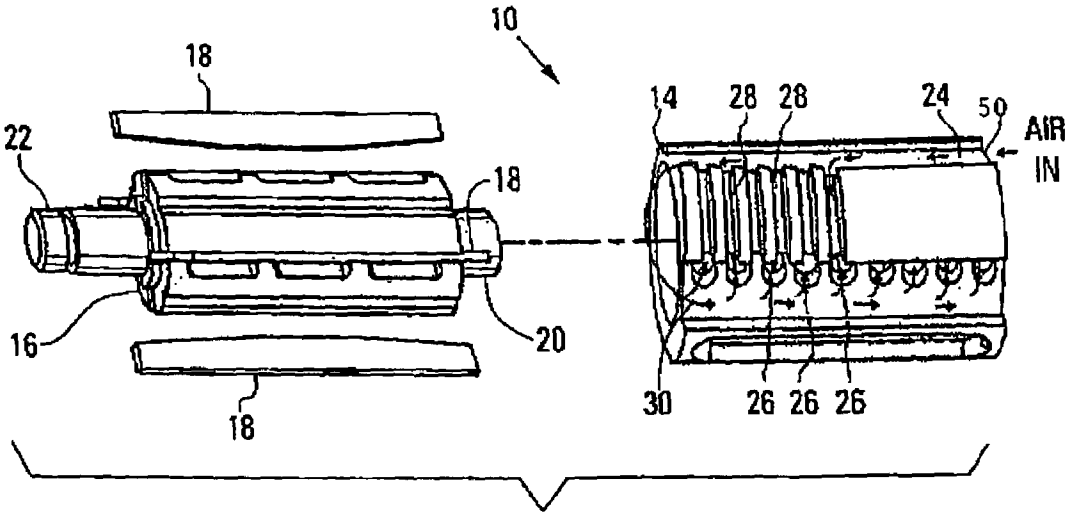
FIG. 1 is an exploded view in perspective of the vane motor of this invention.

The invention is best seen by referring to all the Figs. where FIG. 1 shows the vane motor generally illustrated by reference numeral 10 as having a cylinder 14, a spindle 16 rotary mounted in the cylinder and vanes 18 reciprocally mounted into axial slots formed in the spindle 16. The spindle 16 may include the stub shafts 20 and 22 which are typically supported by bearings. This particular vane and cylinder is specifically detailed in the provisional patent applications, supra, and for details thereof reference should be made thereto which are incorporated herein by reference. Suffice it to say that air enters the cylinder 14 via inlet 50 and flows through the axial passage or through passageway 24 and the air is admitted into inlet holes 26 via the circumferential slots 28. In some designs all the pressurized air is admitted via this axial through passageway or passage 24. However in this embodiment the air is circulated around the bearing (not shown) for cooling purposes and re-admitted into the axial flow through passageway or slot 30 where the remaining pressurized air is admitted into the vane motor via the inlet holes 26. Obviously, as is well known the pressurized air impinges on the vanes during the power stroke to rotate the spindle and produce power and the remaining portion is discharged through the discharge holes (not shown) during the exhaust stroke.

Figure 2:
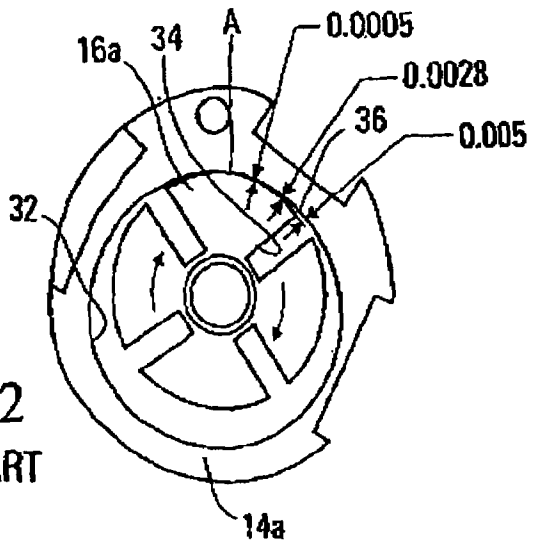
FIG. 2 PRIOR ART
FIG. 2 is a view of a prior art configuration in schematic of the spindle and cylinder of a vane motor.

Reference is next made to FIG. 2 which illustrates by the schematic the cylinder 14*a* and spindle 16*a* of the vane motor of the type that is depicted in FIG. 1. This is a representation of the prior art configuration where the spindle that is eccentrically mounted in the bore 32 of the cylinder 14*a* comes into contact at the tangent of the interface of these two components which is sometimes referred to as the pinch point and is being represented by reference letter A. As shown by the dimensions in FIG. 2 the contact point is at five ten thousand of an inch (0.0005") and the space adjacent the pinch point becomes progressively larger as say by 0.0027" to 0.005" at the edge 34 of the slot 36 and continues.

Figure 3:
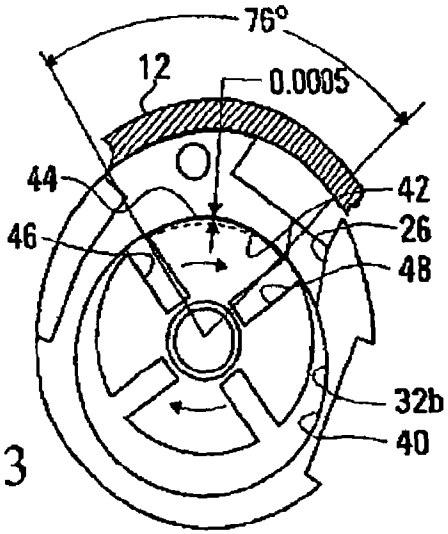
FIG. 3 is a view of the configuration in schematic of the spindle and cylinder of a vane motor modified in accordance with this invention.

In accordance with this invention as best seen in FIG. 3 the cylinder surface 40 in bore 32*b* is undercut at the interface of the cylinder 14 and spindle 16 just upstream of the power stroke as represented by the exaggerated dash lines 42. For clarity a partial showing of the housing 12 is included to show the relationship of the spindle and cylinder and the vanes are eliminated from their respective slots. The undercut distorts the circular shape of the cylindrical surface 40 which allows the spindle to increase the area of contact so as to define the crescent seal indicated by reference numeral 44. The crescent seal 44 by virtue of this invention spans the contact distance to a dimension that includes the arc that measures substantially 76 degrees and the arc is between adjacent vane slots 46 and 48. Obviously, the dimension of the crescent seal would be predicated on the size of the vane motor and the dimension of the depth of the undercut. These factors will, of course, determine the length of the seal. It should be realized from the foregoing that the crescent seal extends from the exhaust stroke position where the interface of the spindle and cylinder are in close contact and the position of the vane (or slot) when it is at the beginning of the power stroke which is adjacent to inlet 26. The consequence of length of the crescent seal and its attendant gap enhances the sealing ability of the spindle to cylinder gap. This increased effectiveness of the seal, in turn, is translated into the vane motor's ability to operate with significantly less lubrication without impairing the life of the rotary machine.

Although this invention has been shown and described with respect to detailed embodiments thereof, it will be appreciated and understood by those skilled in the art that various changes in form and detail thereof may be made without departing from the spirit and scope of the disclosed invention.

I claim:

1. Means for improving the sealing characteristics of a vane motor, said means including a spindle having a cylindrical shape, a cylinder having a cylindrically shaped inner surface, said spindle being rotary mounted in said cylinder and being eccentric relative to said cylindrically shaped inner surface, a crescent seal formed between the interface of said cylindrically shaped inner surface and said spindle by deforming said cylindrically shaped inner surface to a non-cylindrical shape and the deformation defining a gap extending a predetermined distance, wherein said gap at said interface is substantially equal to 0.0005 inch and said predetermined distance is equal to an arc of substantially 76 degrees, and whereby the lubrication requirements of said vane motor are reduced.

2. A vane motor having a spindle having a cylindrical shape, a cylinder having a cylindrically shaped inner surface and outer surface, said cylinder having a first through passageway extending axially on said outer surface on one side of said cylinder and a second through passageway axially extending on an opposite side of said cylinder for flowing air, a plurality of circumferentially extending slots interconnecting said through first through passageway and said second through passageway, said spindle being rotary mounted in said cylinder and being eccentric relative to said inner surface, a crescent seal formed between the interface of said inner surface and said spindle by deforming said inner surface to a non-cylindrical shape and the deformation defining a gap and extending a predetermined distance, wherein the gap at said interface is substantially equal to 0.0005 inch and said predetermined distance is equal to an arc of substantially 76 degrees, and whereby the lubrication requirements of said vane motor are reduced and said first through passageway and said second through passageway lead air into said vane motor through a plurality of holes formed in said cylinder for powering said vane motor.

3. A vane motor as claimed in claim 2 wherein said holes are cylindrical.

4. A vane motor as claimed in claim 3 wherein said plurality of said circumferentially extending slots extend only a portion of the length of said cylinder.

5. A vane motor as claimed in claim 4 wherein said cylinder includes an inlet for admitting air into said first through passageway and said plurality of said circumferentially extending slots begin downstream of said inlet.

* * * * *